US009824563B2

(12) United States Patent
Uchida

(10) Patent No.: US 9,824,563 B2
(45) Date of Patent: Nov. 21, 2017

(54) FIRE MONITORING SYSTEM AND SMOKE DETECTOR

(71) Applicant: Nohmi Bosai Ltd., Chiyoda-ku, Tokyo (JP)

(72) Inventor: Masamichi Uchida, Tokyo (JP)

(73) Assignee: NOHMI BOSAI LTD., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/437,533

(22) Filed: Feb. 21, 2017

(65) Prior Publication Data

US 2017/0249819 A1 Aug. 31, 2017

(30) Foreign Application Priority Data

Feb. 29, 2016 (JP) ..... 2016-037397

(51) Int. Cl.

| | |
|---|---|
| ***G08B 17/10*** | (2006.01) |
| ***G08B 29/00*** | (2006.01) |
| ***G08B 17/00*** | (2006.01) |
| ***G08B 25/00*** | (2006.01) |

(52) U.S. Cl.

CPC ..... *G08B 17/10* (2013.01)

(58) Field of Classification Search

CPC ..... G08B 17/10; G08B 29/04; G01N 21/53; G01N 21/00

USPC .... 340/328, 630, 632, 506, 587, 304, 693.6; 356/338

See application file for complete search history.

(56) References Cited

U.S. PATENT DOCUMENTS

| | | | | |
|---|---|---|---|---|
| 5,798,701 | A * | 8/1998 | Bernal | G08B 17/10 250/574 |
| 6,107,925 | A * | 8/2000 | Wong | G08B 17/10 340/628 |
| 9,267,884 | B2 * | 2/2016 | Knox | G01N 21/53 |
| 9,448,168 | B2 * | 9/2016 | Knox | G01N 21/53 |
| 2006/0261967 | A1 * | 11/2006 | Marman | G08B 17/103 340/630 |
| 2013/0258335 | A1 * | 10/2013 | Kato | G08B 17/107 356/338 |
| 2016/0042638 | A1 * | 2/2016 | Sangha | G08B 29/043 340/628 |

FOREIGN PATENT DOCUMENTS

JP 2013-003760 A 1/2013

* cited by examiner

*Primary Examiner* — George Bugg
*Assistant Examiner* — Munear Akki
(74) *Attorney, Agent, or Firm* — Buchanan Ingersoll & Rooney PC

(57) ABSTRACT

A fire monitoring system includes a smoke detector, a first correction unit obtaining a first corrected value by multiplying a difference value between a reference value and a detection value by a first correction coefficient, a first conversion unit converting the first corrected value into a first smoke density, and a fire determination unit determining occurrence of a fire event based on the first smoke density. The first correction coefficient is set on an increase side corresponding to an increase in a rate of change of the reference value to an initial reference value, and an upper limit value is set for the first correction coefficient.

9 Claims, 9 Drawing Sheets

FIRE MONITORING SYSTEM AND SMOKE DETECTOR

TECHNICAL FIELD

The present invention relates to a fire monitoring system and a smoke detector. The fire monitoring system includes the smoke detector, which is configured to output a detection value corresponding to a smoke density, and a fire alarm control unit configured to receive the detection value output from the smoke detector.

BACKGROUND ART

There has been known a photoelectric smoke detector including a light emitting element and a light receiving element within a smoke detection chamber, the smoke detector being configured to cause the light receiving element to detect light emitted from the light emitting element to output a detection value of the light receiving element corresponding to a smoke density in the smoke detection chamber. Sensitivity of the light receiving element included in the photoelectric smoke detector configured as described above changes with time due to factors such as dirt adhering to the smoke detection chamber, the light emitting element and the light receiving element. There has been proposed a technology for correcting the sensitivity of the light receiving element in order to more accurately detect the smoke density even in a case where the above-mentioned change with time has occurred (see, for example, Patent Literature 1).

CITATION LIST

Patent Literature

Patent Literature 1: Japanese Unexamined Patent Application Publication No. 2013-3760 (Abstract)

SUMMARY OF INVENTION

Technical Problem

In the smoke detector disclosed in Patent Literature 1 described above, the sensitivity of the light receiving element is corrected through use of a correction characteristic that associates the sensitivity of the light receiving element with a usage time of the light receiving element. In Patent Literature 1, it is assumed that the amount of dust or dirt accumulated in the smoke detection chamber housing the light receiving element increases as the usage time of the light receiving element increases. As a result, it is thought that scattered light within the smoke detection chamber increases to increase output from the light receiving element. Under this assumption, the output from the light receiving element is corrected corresponding to the usage time.

When the smoke detector is cleaned to remove the dust or dirt under a state in which a correction amount of the output from the light receiving element is increased corresponding to the usage time, the sensitivity of the light receiving element in the smoke detector returns to an initial state, that is, a state in which no dust or no dirt has accumulated. However, as the sensitivity of the light receiving element is in a corrected state, an actual smoke density may not be accurately detected.

The present invention has been made in view of the above-mentioned problem, and provides a fire monitoring system and a smoke detector capable of easing reduction in detection accuracy of a smoke density after a factor contributing to change in sensitivity such as contaminants is eliminated through a task such as cleaning under a state in which the sensitivity of the smoke detector has been corrected.

Solution to Problem

According to one embodiment of the present invention, a fire monitoring system includes a smoke detector including a light emitting element and a light receiving element provided in a smoke detection chamber, the smoke detector being configured to output a detection value of the light receiving element corresponding to a smoke density in the smoke detection chamber, a fire alarm control unit configured to receive output from the smoke detector, a reference value storage unit configured to store a reference value being the detection value of the light receiving element when the smoke density is zero, a first correction unit configured to obtain a first corrected value by multiplying a difference value between the reference value and the detection value of the light receiving element by a first correction coefficient, a first conversion unit configured to convert the first corrected value into a first smoke density, a fire determination unit configured to determine occurrence of a fire event based on a result of comparison between the first smoke density and a fire threshold value. The first correction coefficient is set on an increase side corresponding to an increase in a rate of change of the reference value with respect to an initial reference value being an initial value of the reference value, and an upper limit value is set for the first correction coefficient.

According to one embodiment of the present invention, a smoke detector includes a light emitting element and a light receiving element provided in a smoke detection chamber, the smoke detector being configured to determine occurrence of a fire event based on a detection value of the light receiving element receiving light emitted from the light emitting element, a reference value storage unit configured to store a reference value being the detection value of the light receiving element when the smoke density is zero, a first correction unit configured to obtain a first corrected value by multiplying a difference value between the reference value and the detection value of the light receiving element by a first correction coefficient, a first conversion unit configured to convert the first corrected value into a first smoke density, a fire determination unit configured to determine occurrence of the fire event based on a result of comparison between the first smoke density and a fire threshold value. The first correction coefficient is set on an increase side corresponding to an increase in a rate of change of the reference value with respect to an initial reference value being an initial value of the reference value, and an upper limit value is set for the first correction coefficient.

Advantageous Effects of Invention

According to one embodiment of the present invention, it is possible to ease reduction in detection accuracy of the smoke density after a factor contributing to change in sensitivity such as contaminants, is eliminated through a task such as cleaning under a state in which the sensitivity of the smoke detector has been corrected. Further, an abnormality in the smoke detector due to contamination can be detected.

DESCRIPTION OF EMBODIMENTS

Figure 1:
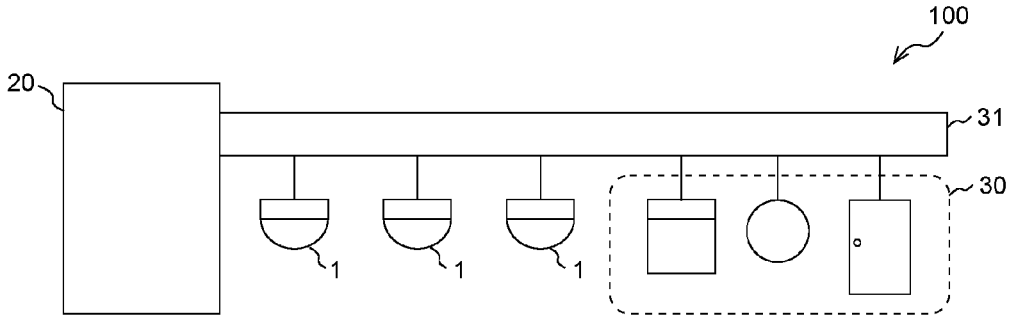
FIG. 1 is a schematic diagram for illustrating a fire monitoring system according to Embodiment 1 of the present invention.

A fire monitoring system and a smoke detector according to embodiments of the present invention are described referring to the drawings. The present invention is not limited to the illustrated embodiments described below, and appropriate changes and modifications may be made within the scope of the technical idea of the present invention.

Embodiment 1

FIG. 1 is a schematic diagram for illustrating a fire monitoring system according to Embodiment 1 of the present invention. A fire monitoring system 100 includes smoke detectors 1, and a fire alarm control unit 20 connected to the smoke detectors 1 via a transmission line 31. A terminal device group 30 is further connected to the transmission line 31 of the fire monitoring system 100 of this embodiment. The terminal device group 30 includes any one of or an arbitrary combination of a fire detector, an alarm device, a smokeproof and smoke exhaust device, and a transmitter. The fire detector includes a sensor configured to detect a physical phenomenon resulting from a fire, such as infrared rays, ultraviolet rays, and combustion gas, and is configured to output a detection value corresponding to the physical phenomenon resulting from a fire. The alarm device may be a device configured to output a sound alarm such as a bell or a speaker, or a light alarm device configured to output a visual alarm such as a flashlight. The smokeproof and smoke exhaust device may be a fireproof door, a shutter, or other such device. The transmitter intermediates between the fire alarm control unit 20 and the smoke detector 1, or between the fire alarm control unit 20 and the terminal device group 30, and is configured to relay a signal. The detailed configuration of the terminal device group 30 described above is merely an example, and the devices in the terminal device group 30 do not need to be specifically differentiated from each other in this embodiment.

The fire alarm control unit 20 is configured to receive the detection value from the smoke detector 1 or the fire detector included in the terminal device group 30 connected to the fire alarm control unit 20 to determine whether or not a fire event has occurred based on the received detection value. When it is determined that a fire has occurred, the fire alarm control unit 20 activates the alarm device, the smokeproof and smoke exhaust prevention device, and performs fire notification processing for notification of occurrence of the fire event.

Figure 2:
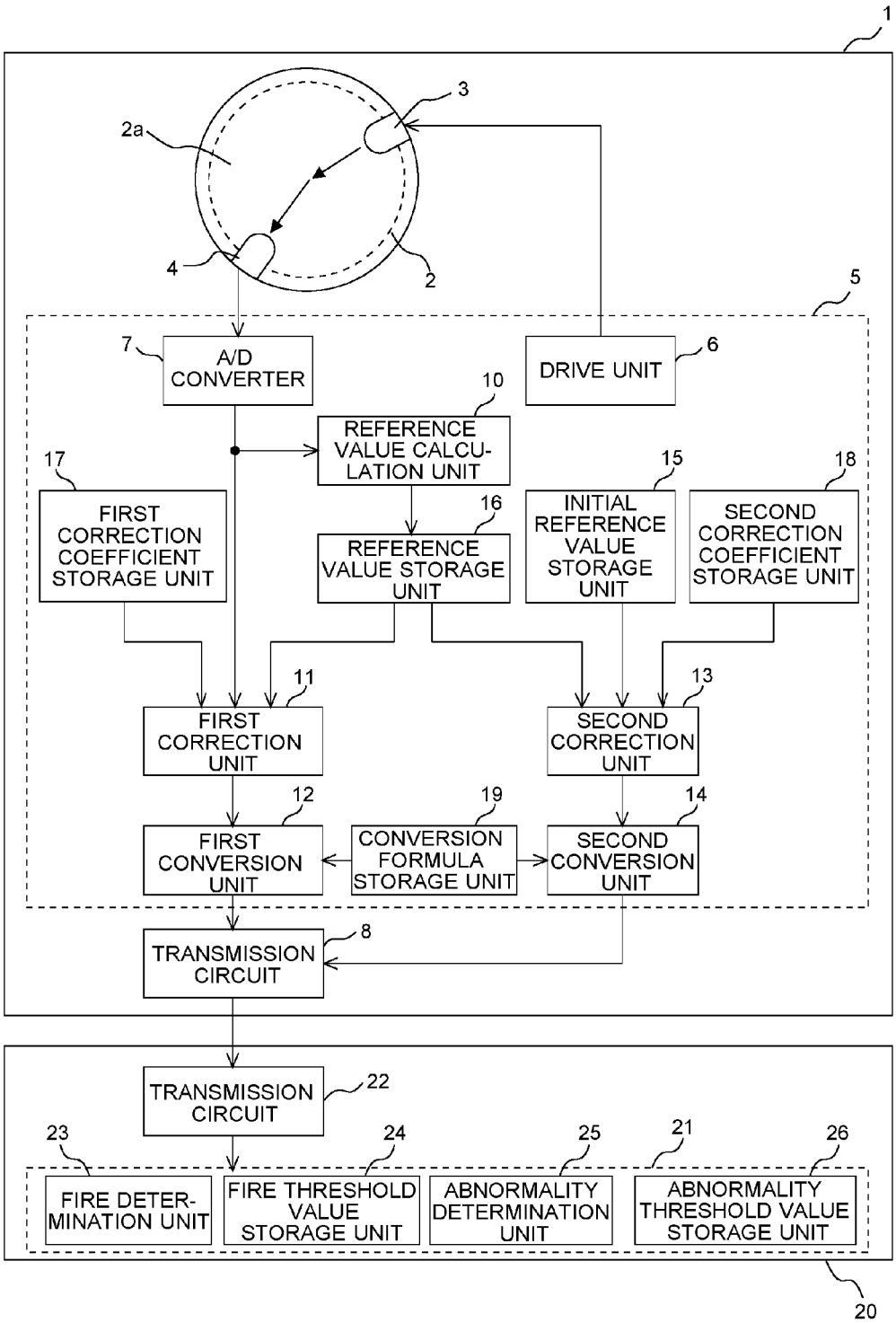
FIG. 2 is a functional block diagram for illustrating a smoke detector and a fire alarm control unit according to Embodiment 1.

FIG. 2 is a functional block diagram for illustrating the smoke detector and the fire alarm control unit according to Embodiment 1. The smoke detector 1 includes a labyrinth inner wall 2 which forms a partition therein as a smoke detection chamber 2*a*. The smoke detector 1 further includes a light emitting element 3 and a light receiving element 4 provided within the smoke detection chamber 2*a*, a control unit 5, and a transmission circuit 8. The control unit 5 includes a drive unit 6 which comprises a drive circuitry configured to control emission of light from the light emitting element 3 to turn on and off the light emitting element 3, and an A/D converter 7 which comprises a circuitry configured to amplify a signal output from the light receiving element 4, convert the signal into a digital value, and output the digital value as the detection value. The transmission circuit 8 is a circuitry configured to transmit or receive signals to or from the fire alarm control unit 20.

The control unit 5 includes a reference value calculation unit 10, a first correction unit 11, a first conversion unit 12, a second correction unit 13, and a second conversion unit 14. The control unit 5 further includes an initial reference value storage unit 15, a reference value storage unit 16, a first correction coefficient storage unit 17, a second correction coefficient storage unit 18, and a conversion formula storage unit 19, which are formed of a memory.

The fire alarm control unit 20 includes a control unit 21 and a transmission circuit 22. The control unit 21 includes a fire determination unit 23, a fire threshold value storage unit 24, an abnormality determination unit 25, and an abnormality threshold value storage unit 26. The transmission circuit 22 comprises a circuitry configured to transmit or receive signals to or from the smoke detector 1. The fire determination unit 23 is configured to compare output from the smoke detector 1 obtained via the transmission circuit 22 and a fire threshold value S stored in the fire threshold value storage unit 24 to determine whether or not a fire has occurred based on the result of the comparison. The abnormality determination unit 25 is configured to compare output from the smoke detector 1 obtained via the transmission circuit 22 and an abnormality threshold value T stored in the abnormality threshold value storage unit 26 to determine whether or not an abnormality has occurred based on the result of the comparison. The fire threshold value storage unit 24 and the abnormality threshold value storage unit 26 are formed of a memory.

The functional units included in each of the control unit 5 and the control unit 21 are embodied by dedicated hardware or a micro processing unit (MPU) configured to execute programs stored in a memory. When the control unit 5 and the control unit 21 are embodied by dedicated hardware, the control unit 5 and the control unit 21 may be a single circuit, a composite circuit, an application specific integrated circuit (ASIC), a field-programmable gate array (FPGA), or a combination of these circuits. The functional units respectively implemented by the control unit 5 and the control unit 21 may be each embodied by individual pieces of hardware, or a single piece of hardware may be used to embody the functional units of the control unit 5 and the control unit 21. When the control unit 5 is an MPU, each function executed by the control unit 5 is embodied by software, firmware, or a combination of software and firmware. The software or the firmware is described as a program and is stored in a memory. The MPU is configured to read out and execute the program stored in the memory, to thereby realize the respective functions of the control unit 5 and the control unit 21. The memory may be a RAM, a ROM, a flash memory, an EPROM, an EEPROM, or other type of non-volatile or volatile semiconductor memory.

Figure 3:
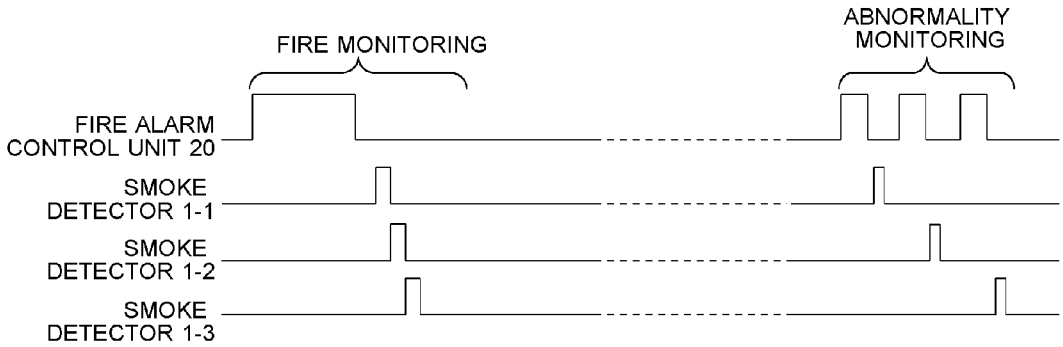
FIG. 3 is a timing chart for illustrating monitoring operations of the smoke detector and the fire alarm control unit according to Embodiment 1.

FIG. 3 is a timing chart for illustrating monitoring operations of the smoke detector and the fire alarm control unit according to Embodiment 1. FIG. 3 is an illustration of outlines of an operation of fire monitoring and an operation of abnormality monitoring of the smoke detector 1, taking a case in which three smoke detectors 1-1, 1-2, and 1-3 are connected to one fire alarm control unit 20 as an example.

(Fire Monitoring)

The fire alarm control unit 20 outputs signals requesting information on the smoke density to each of the smoke detectors 1-1, 1-2, and 1-3 at the same time periodically, for example, at a period of once every four seconds, and thereafter enters a standby state. The smoke detectors 1-1 to 1-3 are usually in a standby state. When the smoke detectors 1-1 to 1-3 obtain the signal requesting information on the smoke density from the fire alarm control unit 20, the smoke detectors 1-1 to 1-3 transmit a signal corresponding to the detected smoke density together with identification information on each of the smoke detectors 1-1 to 1-3. Transmission timing is set in advance for each of the smoke detectors 1-1 to 1-3 so that transmission does not overlap. Each of the smoke detectors 1-1 to 1-3 transmits information on the smoke density in accordance with their respective transmission timings. The fire alarm control unit 20 determines whether or not a fire has occurred based on the smoke density received from each of the smoke detectors 1-1 to 1-3.

(Abnormality Monitoring)

In addition to the normal fire monitoring described above, information on abnormality monitoring is communicated between the fire alarm control unit 20 and the smoke detector 1 to confirm whether or not an abnormality has occurred in the smoke detector 1. The occurrence of abnormality is monitored periodically, for example, at a period of once every 24 hours, and individually between the fire alarm control unit 20 and each of the smoke detectors 1. Specifically, the fire alarm control unit 20 outputs a signal requesting the abnormality monitoring to the smoke detector 1-1 and then enters the standby state. When the smoke detector 1-1 obtains the signal requesting information on the abnormality monitoring from the fire alarm control unit 20, the smoke detector 1-1 outputs information on an abnormality together with identification information on the smoke detector 1-1. After the fire alarm control unit 20 obtains the information on the abnormality from the smoke detector 1-1, the fire alarm control unit 20 determines whether or not an abnormality has occurred based on the information. When it is determined that an abnormality has occurred, the fire alarm control unit 20 outputs a notification of the occurrence of the abnormality through use of a sound output unit or a display unit such as a display or a lamp included in the fire alarm control unit 20, or a sound output unit or a display unit such as a lamp included in the smoke detector 1-1. In this case, the information on the abnormality includes information on detection accuracy of the smoke detector 1, and more specifically, information indicating a contaminated state of the smoke detection chamber 2*a*, the light emitting element 3, and the light receiving element 4. The fire alarm control unit 20 similarly carries out the communication of abnormality monitoring to/from both the smoke detector 1-2 and the smoke detector 1-3.

Next, detection of the smoke density by the smoke detector 1 and abnormality detection relating to contamination are described in detail.

Figure 4A:
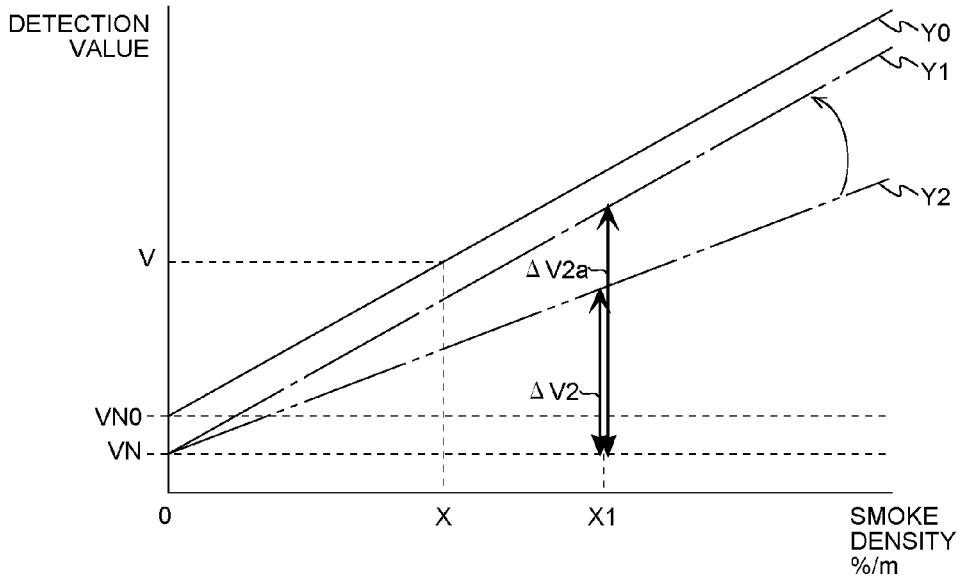
FIG. 4A is a graph for showing a characteristic function of the smoke detector and an example of change in the characteristic function according to Embodiment 1.
Figure 4B:
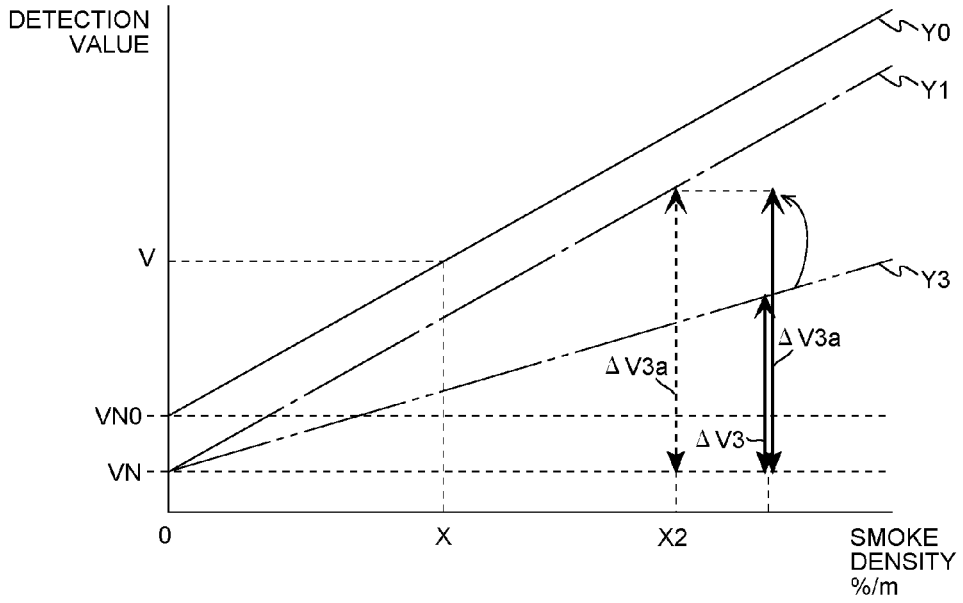
FIG. 4B is a graph for showing a characteristic function of the smoke detector and another example of change in the characteristic function according to Embodiment 1.

FIG. 4A and FIG. 4B are each a graph for showing a characteristic function of the smoke detector and an example of change in the characteristic function according to Embodiment 1. The characteristic function is a function obtained by approximating a correspondence relation between the detection value of the light receiving element 4 and the smoke density by a positive linear function. In FIG. 4A and FIG. 4B, an initial characteristic function Y0 indicated by the solid line is a characteristic function under an initial state. "Initial" refers to a state of the smoke detection chamber 2*a*, the light emitting element 3, and the light receiving element 4 before contamination, usually at the time of being shipped from a factory before use of the smoke detector 1. In the initial characteristic function Y0, the detection value of the light receiving element 4 when the smoke density is zero is referred to as an initial reference value VN0. Through use of the initial characteristic function Y0, the smoke detector 1 can obtain a smoke density X corresponding to a detection value V of the light receiving element 4.

Next, change in the sensitivity of the smoke detector 1 due to contamination is described. When dust or dirt adheres to the labyrinth inner wall 2 to cause white-colored contamination in the smoke detection chamber 2*a*, the reflection amount (noise level) of light emitted from the light emitting element 3 increases. Due to this, the detection value of the light receiving element 4 increases overall to cause the characteristic function of the detection value after the occurrence of the white-colored contamination to shift (parallel translation) higher than the initial characteristic function Y0. On the other hand, when dust or dirt adheres to the labyrinth inner wall 2 to cause black-colored contamination in the smoke detection chamber 2*a*, the reflection amount (noise level) of light emitted from the light emitting element 3 decreases. Therefore, the detection value of the light receiving element 4 decreases overall to cause the characteristic function of the detection value after the occurrence of the black-colored contamination to shift (parallel translation) lower than the initial characteristic function Y0. As described above, when the labyrinth inner wall 2 becomes contaminated, the characteristic function is translated parallel in either an upward or downward direction as shown with characteristic function Y1, and hence a reference value VN being the detection value of the light receiving element 4 when the smoke density is zero increases or decreases.

Further, when dust or dirt adheres to surfaces of the light emitting element 3 and the light receiving element 4 to cause contamination, light transmittance decreases. When light transmittance decreases, a slope (detection sensitivity) of a straight line of a characteristic function after the contamination has occurred falls below the initial characteristic function Y0. That is, even under a condition of the same actual smoke density, the detection value of the light receiving element 4 decreases more after the contamination than before the contamination. FIG. 4A and FIG. 4B each show an example in which characteristic functions Y2 and Y3 expressed as two-dot chain lines have slopes that are smaller than the slope of the initial characteristic function Y0.

As described above, when the smoke detection chamber 2*a*, the light emitting element 3, and the light receiving element 4 become contaminated, the characteristic function changes depending on the type of contamination. Therefore, in order for the smoke detector 1 of this embodiment to obtain a more accurate smoke density, the detection value of the light receiving element 4 is corrected and converted into a smoke density. This correction conceptually involves increasing the decreased slope of the characteristic function. Contamination generally increases over time, and hence a correction amount also increases over time. When the contamination level increases excessively, it becomes difficult to detect the smoke density accurately even when the detection value is corrected. Therefore, an abnormality of the smoke detector 1 is detected based on the contamination level. Further, under a state in which the detection value detected by the smoke detector 1 is corrected, when a factor contributing to lowered sensitivity is eliminated via cleaning the sensitivity of the smoke detector 1 substantially returns to an initial state. However, the detection value is still corrected, and hence accurate detection of the smoke density is difficult depending on the degree of the correction. To address this problem, in the smoke detector 1 of this embodiment, an upper limit is set for the correction of the detection value, as described later, so that a difference in sensitivity of the smoke detector 1 before and after the cleaning is not too large. An operation for detecting the smoke density and an operation for detecting the contamination level are described below.

Figure 5:
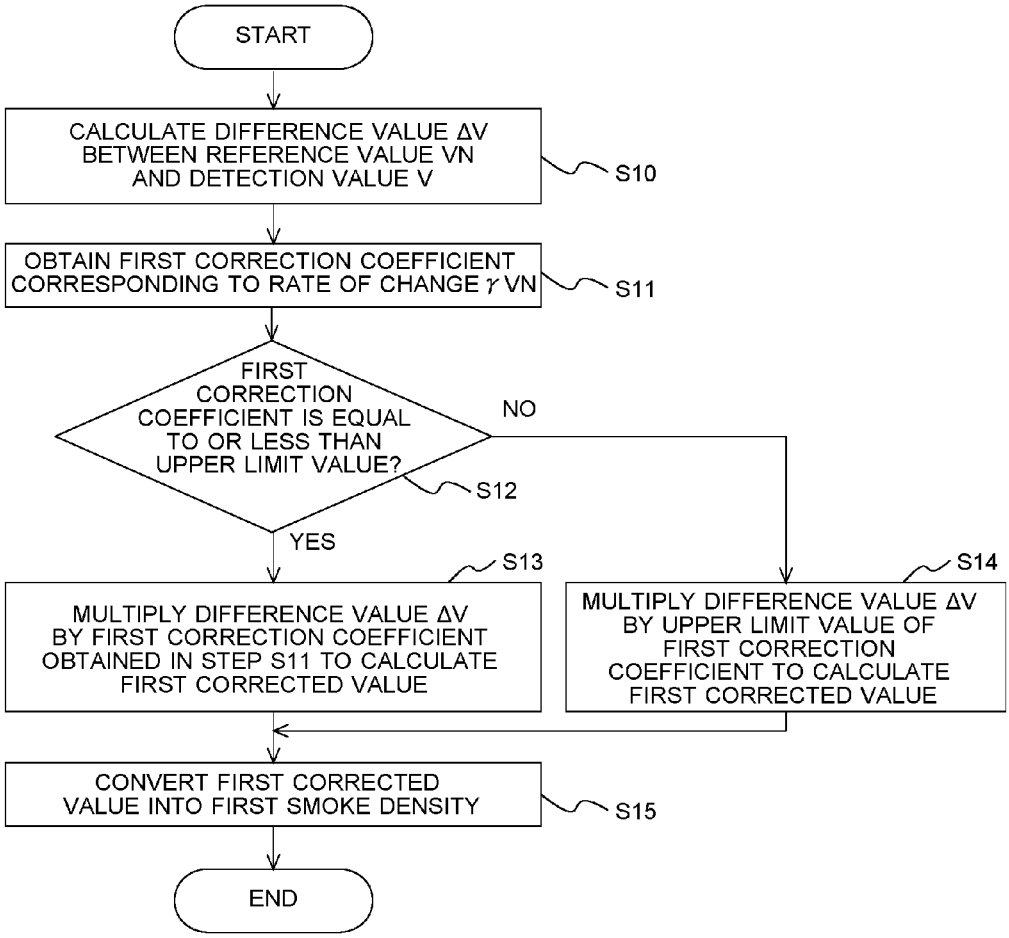
FIG. 5 is a flowchart for illustrating an operation for detecting a smoke density of the smoke detector according to Embodiment 1.

FIG. 5 is a flowchart for illustrating the operation for detecting the smoke density of the smoke detector according to Embodiment 1. The operation for detecting the smoke density is described with reference to FIG. 2 and FIG. 5. As illustrated in FIG. 2, when the light emitting element 3 emits light, the light receiving element 4 receives scattered light reflected by smoke particles within the smoke detection chamber 2*a*, and the detection value V corresponding to the amount of received scattered light is output from the A/D converter 7. The detection value V output from the A/D converter 7 is then input to the reference value calculation unit 10 and the first correction unit 11. In FIG. 5, when processing for detecting the smoke density begins, the first correction unit 11 calculates a difference value ΔV between the reference value VN stored in the reference value storage unit 16 and the detection value V output from the A/D converter 7 (S10).

On this occasion, the reference value VN corresponds to the detection value of the light receiving element 4 when the smoke density is zero. The reference value calculation unit 10 uses the detection value V output from the A/D converter 7 to calculate the reference value VN at a predetermined cycle, and stores the calculated reference value VN in the reference value storage unit 16. The reference value VN may be, for example, a moving average value of detection values output from the A/D converter 7. More specifically, the reference value VN can be calculated by dividing a total value of detection values previously output N times from the A/D converter 7 by a sampling number N, and then dividing a total value of values obtained by iterating processing similar to the above-mentioned processing M number of times by M. The method of calculating the reference value VN is not limited to the above-mentioned method. Calculation processing such as that described above may be iterated to calculate a moving average over 24 hours, for example, and that moving average may be the reference value VN. Through use of the moving average value of the detection values as the reference value VN, influence of disturbance on the detection value can be eased. Further, by periodically updating the reference value VN, a reference value VN corresponding to the state of contamination of the smoke detector 1 can be obtained. Generally, the contamination of the smoke detector 1 is assumed to progress gradually and not change suddenly, and hence the reference value VN does not need to be calculated every time information on fire monitoring is communicated.

The first correction unit 11 obtains from the first correction coefficient storage unit 17 a first correction coefficient corresponding to a rate of change γVN of the reference value VN from the initial reference value VN0 (S11). In this case, the first correction coefficient is a coefficient that corrects the slopes of the characteristic functions shown in FIG. 4A and FIG. 4B. As described above, when the sensitivity of the light receiving element 4 decreases due to contamination, the reference value VN changes from the initial reference value VN0, which is the initial value of the reference value VN. The rate of change γVN of the reference value VN from the initial reference value VN0 and the slope of the characteristic function have a linear proportional relationship. Through use of this proportional relationship, a table or conversion formula for the first correction coefficient created to increase the first correction coefficient corresponding to increase in the rate of change γVN is stored in the first correction coefficient storage unit 17. The table or conversion formula for the first correction coefficient indicates a relationship between the rate of change γVN of the reference value VN and the first correction coefficient that corrects the slope of the characteristic function after the contamination into the slope of the initial characteristic function Y0. The first correction unit 11 refers to the first correction coefficient storage unit 17 to use the first correction coefficient corresponding to the rate of change γVN. The rate of change γVN of the reference value VN can be, for example, an absolute value (=|(VN−VN0)/VN0|) of a value obtained by dividing (normalizing) a difference value between the reference value VN and the initial reference value VN0 by the initial reference value VN0.

The first correction unit 11 determines whether or not the first correction coefficient obtained in Step S11 is equal to or less than an upper limit value set in advance (S12). When it is determined in Step S12 that the first correction coefficient obtained in Step S11 is equal to or less than the upper limit value (S12; YES), the difference value ΔV obtained in Step S10 is multiplied by the first correction coefficient obtained in Step S11 to calculate the first corrected value (S13). When it is determined in Step S12 that the first correction coefficient obtained in Step S11 exceeds the upper limit value (S12; NO), the first correction unit 11 multiplies the difference value ΔV by the upper limit value of the first correction coefficient to calculate the first corrected value (S14). The first conversion unit 12 converts the first corrected value calculated in Step S13 or Step S14 into a first smoke density (S15). The conversion formula storage unit 19 stores the initial characteristic function Y0 indicating the relationship between the detection value of the light receiving element 4 and the smoke density as a conversion formula. The first conversion unit 12 of the control unit 5 is capable of using the initial characteristic function Y0 to convert the first corrected value into the first smoke density converted in Step S15.

The first correction coefficient and the upper limit value of the first correction coefficient are described with reference to FIG. 4A and FIG. 4B. First, a case is assumed where the sensitivity of the light receiving element 4 has decreased, and the characteristic function of the smoke detector 1 is the characteristic function Y2 shown in FIG. 4A. A difference value ΔV2 between the detection value of the light receiving element 4 and the reference value VN is multiplied by the first correction coefficient corresponding to the rate of change γVN of the reference value VN. Hence, a difference value ΔV2*a* between the detection value V and the reference value VN for the characteristic function Y1 having the same slope as the initial characteristic function Y0 is obtained. The difference value ΔV2*a* of FIG. 4A is the first corrected value in Step S13 of FIG. 5, and can be said to be a value obtained by correcting the difference value ΔV2 on an increase side. The slope of the characteristic function Y1 is the same as the slope of the initial characteristic function Y0, and therefore a smoke density X1 indicated by the difference value ΔV2*a* in the characteristic function Y1 and the smoke density X indicated by a value the same size as the difference value ΔV2*a* in the initial characteristic function Y0 take the same value. Therefore, the difference value ΔV2*a* corrected by the first correction coefficient is converted into a smoke density through use of the initial characteristic function Y0, to thereby obtain a smoke density of a state in which the sensitivity is corrected.

On this occasion, as described above, the table or conversion formula for the first correction coefficient stored in the first correction coefficient storage unit 17 indicates the relationship between the rate of change γVN of the reference value VN and the first correction coefficient. In the relationship, a larger rate of change γVN results in a larger first correction coefficient. However, in this embodiment, an upper limit value is set for the first correction coefficient, and hence, when the first correction coefficient reaches the upper limit value, the first correction coefficient is maintained at the upper limit value even if the rate of change γVN of the reference value VN from the initial reference value VN0 further increases.

As shown in FIG. 4B, in an example in which the sensitivity of the light receiving element 4 decreases below the state of the characteristic function Y2 and is in the state of the characteristic function Y3, the upper limit value of the first correction coefficient is investigated. A difference value ΔV3 between the detection value V of the characteristic function Y3 and the reference value VN is multiplied by the first correction coefficient to calculate the first corrected value. However, when the first correction coefficient for correcting the characteristic function Y3 such that the slope of the characteristic function Y3 becomes the same as the slope of the characteristic function Y1 (=the slope of the initial characteristic function Y0) exceeds the upper limit value, the upper limit value is used as the first correction coefficient. As shown in FIG. 4B, a value ΔV3*a* obtained by correcting the difference value ΔV3 with the upper limit value is projected onto a characteristic function having a slope smaller than the slope of the characteristic function Y1 (=the slope of the initial characteristic function Y0). As described above, an upper limit value is set for the first correction coefficient to prevent the first correction coefficient from becoming too large, thereby enabling a difference between the difference value ΔV3 before correction and the value ΔV3*a* after correction to be reduced. The value ΔV3*a* corrected by the upper limit value of the first correction coefficient is converted into a smoke density X2 through use of the initial characteristic function Y0.

The upper limit value of the first correction coefficient can be determined in accordance with required detection accuracy of the smoke density and standards that are required to be adhered to. For example, the smoke density corresponding to the first corrected value obtained by multiplying the difference value ΔV between the detection value V and the reference value VN by the upper limit value of the first correction coefficient is assumed to be a value that falls within a range of +50% of the fire threshold value S. For example, when the fire threshold value S is 11%/m, the first correction coefficient with which the smoke density calculated based on the detection value after correction becomes 16.5%/m is the upper limit value.

As described above, the difference value ΔV between the detection value V and the reference value VN is corrected through use of the first correction coefficient corresponding to the rate of change γVN of the reference value VN, to thereby enable the smoke density to be detected at a sensitivity equivalent to the initial sensitivity of the smoke detector 1. In addition, an upper limit value is set for the first correction coefficient. Therefore, under a state in which correction is applied when a factor contributing to a decrease in sensitivity of the smoke detector 1 is eliminated by cleaning so that the sensitivity returns to the initial state, a difference between the smoke density based on the value after the correction and the actual smoke density can be reduced even when correction is continued, compared to a case where no upper limit value is set for the first correction coefficient. Therefore, reduction in the detection sensitivity of the smoke density after the smoke detector 1 is cleaned can be eased. In particular, as described above, when a moving average of the detection values is used in calculation of the reference value VN, the upper limit value for the first correction coefficient works effectively. Specifically, through use of the moving average of the detection values in the calculation, influence of disturbance on the reference value VN can be eased. In contrast, even when the detection accuracy is improved through cleaning, the detection value before cleaning is reflected in the reference value VN by the moving average, and thus the first correction coefficient may become a value larger than necessary. To address this problem, as described in this embodiment, an upper limit value is set for the first correction coefficient to prevent an excessive correction, thereby reducing erroneous detection of the smoke density by the smoke detector 1 after cleaning. After the smoke detector 1 is cleaned, the reference value VN becomes the initial reference value VN0 or a value close to the initial reference value VN0. Even when a moving average value is used in the calculation of the reference value VN, the reference value VN and the first correction coefficient are each gradually made appropriate as time passes.

As described above, when an upper limit value is set for the first correction coefficient, further contamination of the smoke detector 1 causes the smoke density that is to be detected and the actual smoke density to dissociate from each other. To address this problem, in this embodiment, the contamination levels of the smoke detection chamber 2*a*, the light emitting element 3, and the light receiving element 4 are detected to detect an abnormality in the smoke detector 1 based on those contamination levels.

Figure 6:
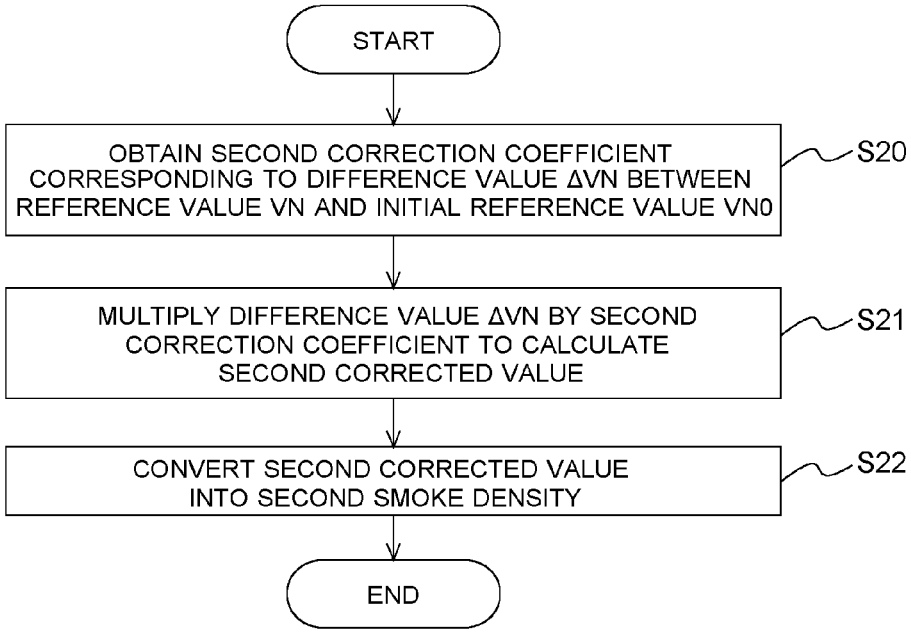
FIG. 6 is a flowchart for illustrating an operation for detecting a contamination level of the smoke detector according to Embodiment 1.

FIG. 6 is a flowchart for illustrating the operation for detecting the contamination level of the smoke detector according to Embodiment 1. The second correction unit 13 of the control unit 5 obtains, from the second correction coefficient storage unit 18, the second correction coefficient corresponding to the difference value ΔVN between the reference value VN stored in the reference value storage unit 16 and the initial reference value VN0 stored in the initial reference value storage unit 15 (S20). The second correction unit 13 then multiplies the difference value ΔVN by the second correction coefficient obtained in Step S20 to calculate a second corrected value (S21). Next, the second conversion unit 14 converts the second corrected value calculated in Step S21 into a second smoke density using the characteristic function stored in the conversion formula storage unit 19 (S22). In this way, in this embodiment, a difference value between the reference value VN and the initial reference value VN0 (difference value ΔVN) is corrected, and the value converted into the second smoke density in Step S22 is used as the contamination level.

The second correction coefficient is described. The difference value between the reference value VN and the initial reference value VN0 (difference value ΔVN) and the contamination level of the labyrinth inner wall 2, the light emitting element 3, and the light receiving element 4 have a linear proportional relationship. Through use of this proportional relationship, a correspondence table or conversion formula for the second correction coefficient created such that the second correction coefficient increases as the difference value ΔVN increases is stored in the second correction coefficient storage unit 18. The correspondence table or conversion formula indicates the relationship between an absolute value of the difference value ΔVN between the reference value VN and the initial reference value VN0, and the second correction coefficient. The second correction unit 13 uses the second correction coefficient corresponding to the difference value ΔVN to correct the difference value ΔVN.

Figure 7:
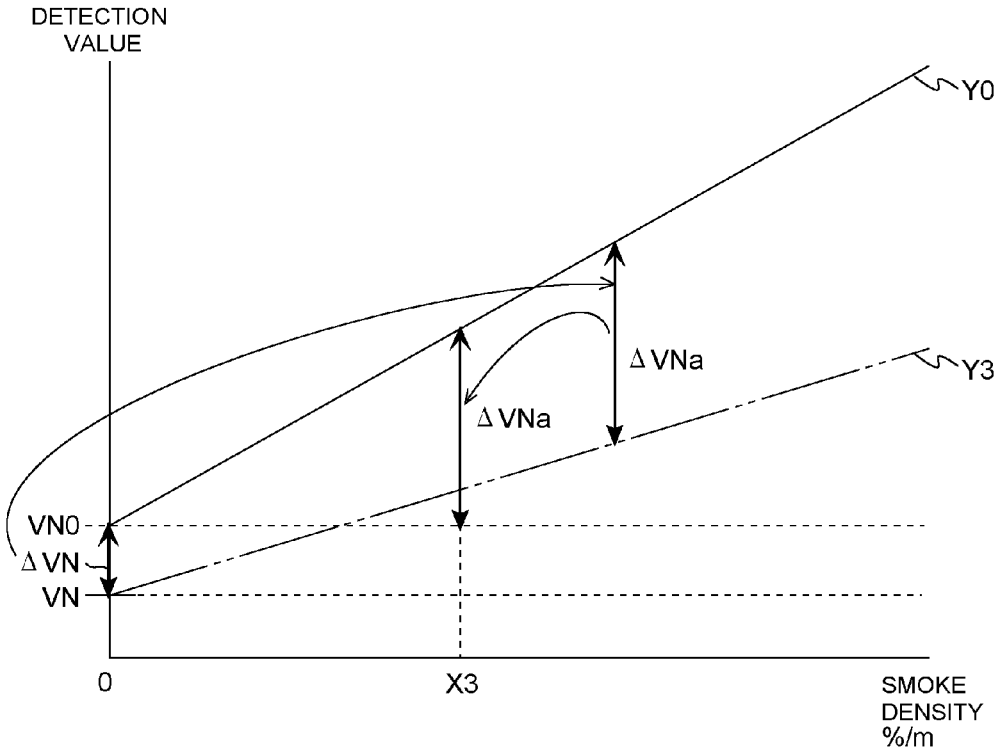
FIG. 7 is a graph for showing a relationship between a reference value and the contamination level indicated by the smoke density of the smoke detector according to Embodiment 1.

FIG. 7 is a graph for showing a relationship between the reference value VN of the smoke detector according to Embodiment 1 and the contamination level indicated by the smoke density. In FIG. 7, the initial characteristic function Y0 and the characteristic function Y3 after contamination are the same as those shown in FIG. 4B. As described above, the reference value VN changes from the initial reference value VN0 as each of the smoke detection chamber 2*a*, the light emitting element 3, and the light receiving element 4 is contaminated. A second corrected value ΔVNa obtained by multiplying the difference value ΔVN between the reference value VN and the initial reference value VN0 by the second correction coefficient indicates a difference between the detection value in the initial characteristic function Y0 and the detection value in the characteristic function Y3 after contamination. A smoke density X3 is obtained by applying the second corrected value ΔVNa to a conversion formula for the initial characteristic function Y0. In other words, a smoke density that corresponds to a difference between a smoke density when the detection value is converted using the actual characteristic function Y3 and the smoke density when the detection value is converted using the initial characteristic function Y0, is obtained as the smoke density X3. Therefore, the smoke density X3 is used as information indicating the contamination level.

The information on the smoke density X3 is transmitted to the fire alarm control unit 20. The abnormality determination unit 25 of the fire alarm control unit 20 is configured to determine occurrence of an abnormality when the smoke density X3 exceeds the abnormality threshold value T stored in advance. The abnormality threshold value T is, for example, determined to be a value within ±50% of the fire threshold value S according to UL268. Therefore, when the abnormality threshold value T conforms to UL standards and the fire threshold value S of the smoke density is 11%/m, the abnormality threshold value T is within a range of from 5.5%/m or more to 16.5%/m or less. When the smoke density X3 deviates from this range, the abnormality determination unit 25 determines the occurrence of an abnormality.

In this way, in this embodiment, in the calculation of the smoke density to be used for fire monitoring, the difference value ΔV between the reference value VN and the detection value V is used to calculate the smoke density. Therefore, change in parallel translation of the characteristic function accompanying the contamination is canceled out and the difference value ΔV is multiplied by the first correction coefficient, to thereby correct the slope of the characteristic function and obtain the smoke density using the initial characteristic function Y0. Further, the detection value of the light receiving element 4 is corrected by the first correction coefficient, and thus, even when the sensitivity of the light receiving element 4 decreases due to the contamination, the detection accuracy of the smoke density can be maintained. Further, an upper limit value is set for the first correction coefficient which corrects the detection value of the light receiving element 4. Due to this, it is possible to ease reduction of the detection accuracy of the smoke density by the smoke detector 1 after the sensitivity of the smoke detector 1 returns to an initial state or a state close to the initial state due to cleaning under a state in which the first correction coefficient is set on an increase side. Therefore, reduction of misdetection or non-detection of fire due to the reduction in detection accuracy of the smoke density can be achieved. Further, in addition to the detection of the smoke density, whether or not an abnormality has occurred is determined by calculating the contamination level of the smoke detector 1 based on the difference value between the reference value VN and the initial reference value VN0. Therefore, it is possible to detect an instance in which the smoke detector 1 is no longer able to maintain a predetermined detection accuracy due to contamination or other factors. In this way, in this embodiment, both maintenance of the detection accuracy of the smoke density by the smoke detector 1 after cleaning and detection of an abnormality in the smoke detector 1 due to contamination can be achieved.

Figure 8:
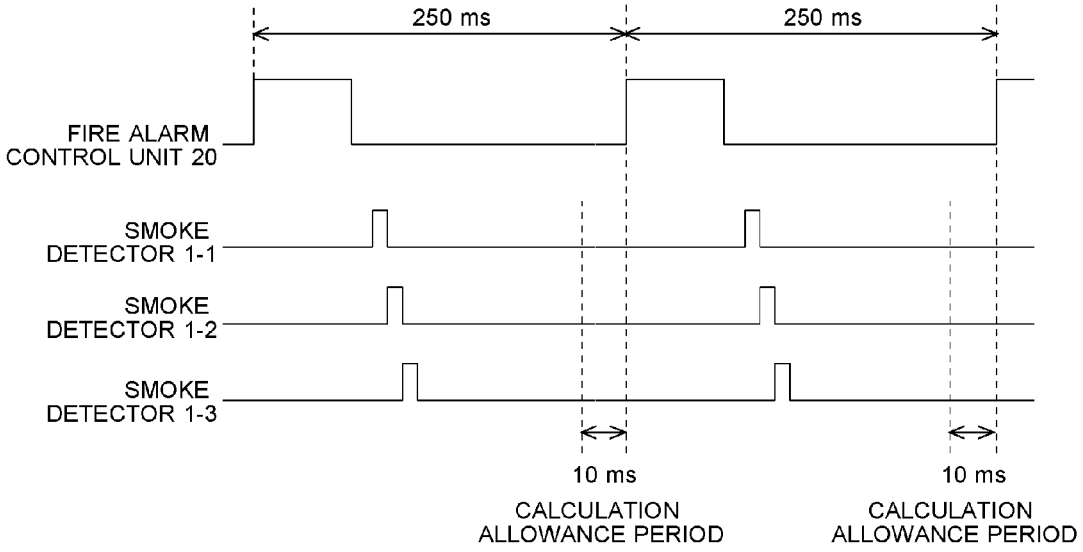
FIG. 8 is a timing chart for illustrating an example of calculation timing of a first corrected value and a second corrected value of the smoke detector according to Embodiment 1.

FIG. 8 is a timing chart for illustrating an example of calculation timing of the first corrected value and the second corrected value of the smoke detector according to Embodiment 1. Based on Article 9 of the "Ministerial Ordinance Stipulating Technical Standards for Receivers", in the fire monitoring system 100, there is defined a calculation allowance period in which the smoke detector 1 may perform operations such as calculation. In light of such constraints, in the example illustrated in FIG. 8, 250 ms is set as one period, and the last 10 ms of that period is designated as the calculation allowance period. The smoke detector 1 is only allowed to perform operations such as calculation in this calculation allowance period. The smoke detector 1 calculates the first corrected value and the second corrected value over the calculation allowance periods in a distributed manner. Configuring the smoke detector 1 as described above allows the smoke detector 1 to conform to relevant standards and be able to ease the influence of a concentrated calculation load on the operation for detecting the smoke density by preventing the smoke detector 1 from simultaneously calculating the first corrected value and the second corrected value.

Embodiment 2

In Embodiment 1, the fire monitoring system 100 including the smoke detector 1 and the fire alarm control unit 20 has a configuration in which whether or not a fire or an abnormality has occurred is determined by the fire alarm control unit 20 based on the first smoke density and the second smoke density output from the smoke detector 1. In Embodiment 2 of the present invention, there is described a smoke detector 1A configured to not only detect the first smoke density and the second smoke density but also determine whether or not a fire or an abnormality has occurred.

Figure 9:
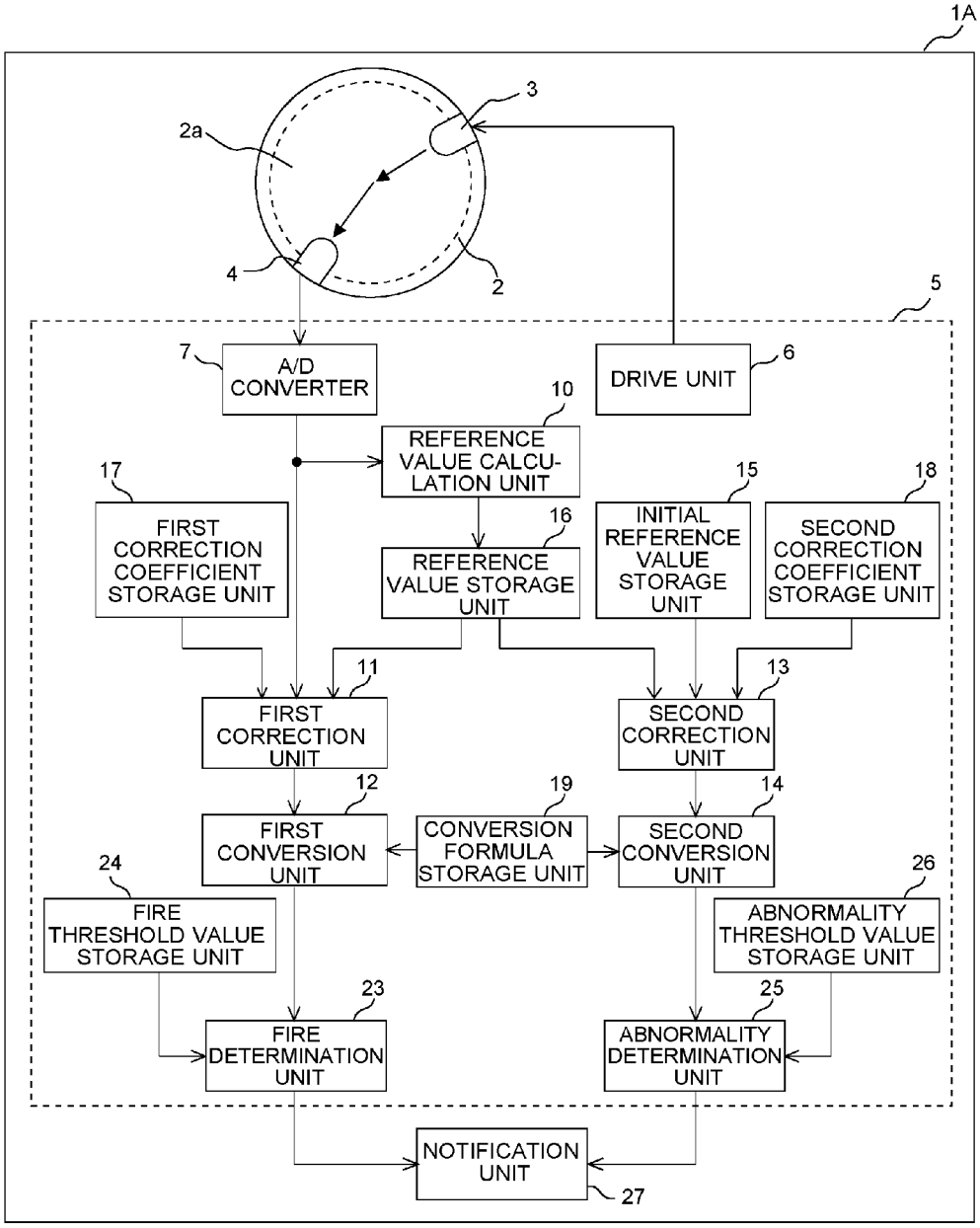
FIG. 9 is a functional block diagram of a smoke detector according to Embodiment 2 of the present invention.

FIG. 9 is a functional block diagram of the smoke detector 1A according to Embodiment 2. The control unit 5 of the smoke detector 1A includes the fire determination unit 23, the fire threshold value storage unit 24, the abnormality determination unit 25, and the abnormality threshold value storage unit 26, which are all included in the fire alarm control unit 20 in Embodiment 1. It is more preferred that the smoke detector 1A include a notification unit 27. The notification unit 27 includes any one of or both of an acoustic device such as a buzzer or a speaker configured to output sound and a display device such as a lamp configured to output visual information. The smoke detector 1A is configured to detect the first smoke density and the second smoke density in a manner similar to that of Embodiment 1, and to further determine whether or not a fire has occurred with the fire determination unit 23 and determine whether or not an abnormality has occurred with the abnormality determination unit 25. When it is determined that a fire has occurred, the notification unit 27 outputs a notification of occurrence of a fire. Similarly, when it is determined that an abnormality has occurred, the notification unit 27 outputs a notification of occurrence of an abnormality.

As described above, even when the smoke detector 1A configured to determine occurrence of a fire or an abnormality is applied to the present invention, effects similar to those of Embodiment 1 can be obtained. In Embodiment 2, as in Embodiment 1, the smoke detector 1A may include the transmission circuit and may be connected to the fire alarm control unit via a transmission line such that when the smoke detector 1A determines occurrence of a fire or an abnormality, the smoke detector 1A may transmit a fire signal or an abnormality signal to the fire alarm control unit.

In Embodiments 1 and 2 described above, an upper limit may be set for the number of times the first correction coefficient is updated. In other words, the first correction coefficient is set on an increase side corresponding to an increase in the rate of change $\gamma VN$ of the reference value VN from the initial reference value VN0 for a predetermined number of times.

The invention claimed is:

1. A fire monitoring system, comprising:

a smoke detector including a light emitting element and a light receiving element provided in a smoke detection chamber, the smoke detector being configured to output a detection value of the light receiving element corresponding to a smoke density in the smoke detection chamber;

a fire alarm control unit configured to receive output from the smoke detector;

a reference value storage unit configured to store a reference value, the reference value being the detection value of the light receiving element when the smoke density is zero;

a first correction unit configured to obtain a first corrected value by multiplying a difference value between the reference value and the detection value of the light receiving element by a first correction coefficient;

a first conversion unit configured to convert the first corrected value into a first smoke density; and a fire determination unit configured to determine occurrence of a fire event based on a result of comparison between the first smoke density and a fire threshold value, wherein the first correction coefficient is set on an increase side corresponding to an increase in a rate of change of the reference value with respect to an initial reference value, the initial reference value being an initial value of the reference value, and wherein an upper limit value is set for the first correction coefficient.

2. The fire monitoring system of claim 1, further comprising:

a second correction unit configured to obtain a second corrected value by multiplying a difference value between the reference value and the initial reference value by a second correction coefficient;

a second conversion unit configured to convert the second corrected value into a second smoke density; and an abnormality determination unit configured to determine occurrence of an abnormality based on a result of comparison between the second smoke density and an abnormality threshold value.

3. The fire monitoring system of claim 1, wherein the first smoke density obtained through use of the upper limit value falls within a range of +50% of the fire threshold value.

4. The fire monitoring system of claim 1, wherein the fire alarm control unit comprises the fire determination unit.

5. The fire monitoring system of claim 2, wherein the fire alarm control unit comprises the abnormality determination unit.

6. A smoke detector, comprising:

a light emitting element and a light receiving element provided in a smoke detection chamber, a reference value storage unit configured to store a reference value, the reference value being a detection value of the light receiving element when the smoke density is zero;

a first correction unit configured to obtain a first corrected value by multiplying a difference value between the reference value and the detection value of the light receiving element by a first correction coefficient;

a first conversion unit configured to convert the first corrected value into a first smoke density; and a fire determination unit configured to determine occurrence of a fire event based on a result of comparison between the first smoke density and a fire threshold value, wherein the first correction coefficient is set on an increase side in accordance with an increase in a rate of change of the reference value with respect to an initial reference value, the initial reference value being an initial value of the reference value, and wherein an upper limit value is set for the first correction coefficient.

7. The smoke detector of claim 6, further comprising:

a second correction unit configured to obtain a second corrected value by multiplying a difference value between the reference value and the initial reference value by a second correction coefficient;

a second conversion unit configured to convert the second corrected value into a second smoke density; and an abnormality determination unit configured to determine occurrence of an abnormality based on a result of comparison between the second smoke density and an abnormality threshold value.

8. The smoke detector of claim 6, wherein the first smoke density obtained through use of the upper limit value falls within a range of +50% of the fire threshold value.

9. The smoke detector of claim 7, wherein the abnormality threshold value falls within a range of ±50% of the fire threshold value.

* * * * *